US009574516B2

(12) United States Patent
Shin et al.

(10) Patent No.: US 9,574,516 B2
(45) Date of Patent: Feb. 21, 2017

(54) ENGINE HAVING CYLINDER BLOCK

(71) Applicants: Hyundai Motor Company, Seoul (KR); Kia Motors Corporation, Seoul (KR)

(72) Inventors: Bosung Shin, Suwon-Si (KR); Yeon Ho Ju, Suwon-Si (KR); Kihyuk Kim, Yongin-Si (KR); Kwang Min Kim, Anyang-Si (KR); Hosung Kim, Seoul (KR); Jin Woo Cho, Seongnam-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 110 days.

(21) Appl. No.: 14/542,578

(22) Filed: Nov. 15, 2014

(65) Prior Publication Data

US 2015/0144090 A1 May 28, 2015

(30) Foreign Application Priority Data

Nov. 27, 2013 (KR) ..... 10-2013-0145551

(51) Int. Cl.

| | |
|---|---|
| ***F02F 1/00*** | (2006.01) |
| ***F02F 1/10*** | (2006.01) |
| *F02F 11/00* | (2006.01) |
| *B22D 19/00* | (2006.01) |
| *F02F 1/20* | (2006.01) |
| *F02F 1/16* | (2006.01) |

(52) U.S. Cl.

CPC ..... *F02F 1/004* (2013.01); *B22D 19/0009* (2013.01); *F02F 1/10* (2013.01); *B22D 19/0081* (2013.01); *F02F 1/16* (2013.01); *F02F 1/20* (2013.01); *F02F 11/005* (2013.01); *F02F 2001/104* (2013.01); *F05C 2201/021* (2013.01); *Y10T 29/49272* (2015.01)

(58) Field of Classification Search

CPC ..... F02F 1/004; F02F 1/20; F02F 1/16; B22D 19/0009; F05C 2201/021

USPC ..... 123/193.2

See application file for complete search history.

(56) References Cited

U.S. PATENT DOCUMENTS 5,732,671 A * 3/1998 Takami ..... B22D 19/0009 123/193.2

FOREIGN PATENT DOCUMENTS

EP 0 744 541 B1 7/1999

* cited by examiner

*Primary Examiner* — Hung Q Nguyen
*Assistant Examiner* — Charles Brauch
(74) *Attorney, Agent, or Firm* — Morgan, Lewis & Bockius LLP

(57) ABSTRACT

Disclosed are an engine having a cylinder block and a method for manufacturing an engine having a cylinder block. The engine may include cylinder liners each having a cylinder space formed therein, a protruded portion formed on an outside circumference thereof, and a flat surface formed on one side of the protruded portion. The cylinder liners may be arranged such that the flat surfaces of adjacent cylinder liners are in close contact with one another. The engine may also include a liner covering unit formed to surround an outside of the cylinder liners, and an outer block which forms a cooling water chamber with an outside surface of the liner covering unit.

9 Claims, 6 Drawing Sheets

ENGINE HAVING CYLINDER BLOCK

CROSS-REFERENCE TO RELATED APPLICATION

The present application claims priority of Korean Patent Application Number 10-2013-0145551 filed on Nov. 27, 2013, the entire contents of which application are incorporated herein for all purposes by this reference.

BACKGROUND OF INVENTION

Field of Invention

The present invention relates to an engine of a vehicle, and more particularly, to an engine having a cylinder block a cylinder liner is applied thereto for forming a combustion chamber and reciprocation of a piston therein by combustion.

Description of Related Art

In general, in order to reduce weight, the cylinder block has been formed of an aluminum alloy. However, though the cylinder block of the aluminum alloy has good castabilty and working properties, the cylinder block of the aluminum alloy has low heat resistance and high abradability. In order to supplement such heat resistance and abradability, the cylinder liner is applied. The cylinder liner has a cylindrical structure, and the cylinder block is casted in a state the cylinder liners are arranged along a preset line.

However, a defective casting is liable to take place due to imperfect filling of cast molten metal caused by a small gap between adjacent cylinder liners. Along with this, since the small gap between the adjacent cylinder liners leads to form a small sealing area at a top side of the adjacent cylinder liners to which a gasket is closely attached to seal compressed gas, the compressed gas is liable to leak.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention are directed to provide an engine having a cylinder block which enables to fill casting molten metal between adjacent cylinder liners without a void for reducing defective casting, maintains a gap between the adjacent cylinders appropriately to prevent a top side sealing area from becoming smaller.

Thus, according to various aspects of the present invention, an engine having a cylinder block may include cylinder liners each having a cylinder space formed therein, a protruded portion formed on an outside circumference thereof, and a flat surface formed on one side of the protruded portion, wherein the cylinder liners are arranged such that the flat surfaces of adjacent cylinder liners are in close contact with one another, a liner covering unit formed to surround an outside of the cylinder liners, and an outer block which forms a cooling water chamber with an outside surface of the liner covering unit.

The protruded portion may be formed at an upper side of each of the cylinder liners along a circumference, and the flat surface may be formed at a portion where the adjacent cylinder liners are in close contact with one another. The flat surface formed at the protruded portion of one or each of the cylinder liners may have a groove formed therein.

The grooves of the adjacent cylinder liners may be substantially symmetrical with respect to a close contact surface defined by the flat surfaces of the adjacent cylinder liners in close contact with one another. The groove may be formed in a diameter direction of the corresponding cylinder liner substantially perpendicular to a first direction in which the cylinder liners are arranged, and may have a cross section larger than a semi-circle but smaller than a circle.

Molten metal for forming the liner covering unit may be filled in the groove. The liner covering unit may be formed of a material that is substantially the same as a material of the outer block. The liner covering unit and the outer block may be formed as one unit by casting.

According to various other aspects of the present invention, a method for manufacturing an engine having a cylinder block may include the steps of manufacturing a plurality of cylinder liners, each having a protruded portion formed on an outside thereof, forming a flat surface at the protruded portion, forming a groove in the flat surface, arranging adjacent cylinder liners such that the flat surfaces are in close contact and the grooves face one another, and casting molten metal to form a liner covering unit which surrounds an outside of the cylinder liners and an outer block which forms a cooling water chamber around the liner covering unit.

The protruded portion may be formed along a circumference at an end portion of the corresponding cylinder liner. The groove may be formed in a diameter direction of the corresponding cylinder liner substantially perpendicular to a first direction in which the cylinder liners are arranged, and may have a cross section larger than a semi-circle but smaller than a circle. Molten metal for forming the liner covering unit may be filled in and secured to the groove.

Since the adjacent cylinder liners are in close contact with one another at the flat surfaces formed at the protruded portions, a position of each of the cylinder liners can be maintained precisely, an assemble error can be reduced, and the top side sealing area can be increased according to a protruded size of the protruded portion.

Moreover, the molten aluminum alloy, filled in the opposite grooves in the flat surfaces of the protruded portions at the time of casting, is hardened and thus can secure the cylinder liners rigidly.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
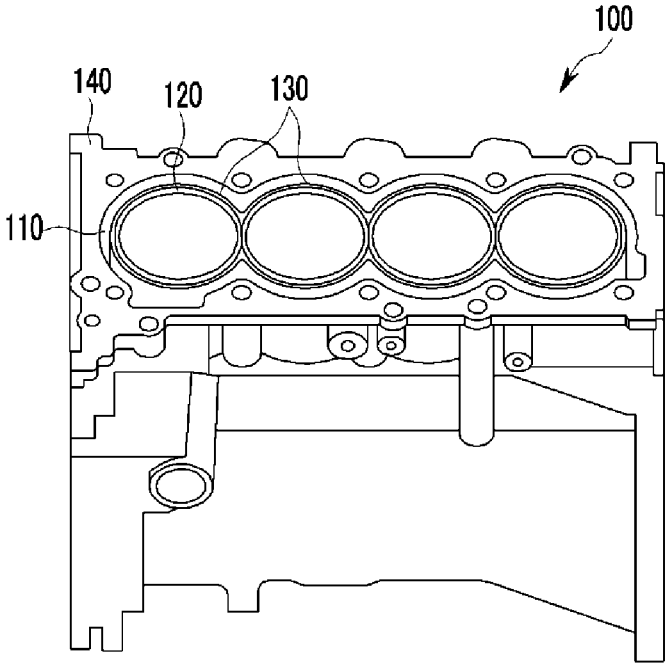
FIG. 1 illustrates a perspective view of a portion of an exemplary engine having a cylinder block in accordance with the present invention.

FIG. 1 illustrates a perspective view of a portion of an engine having a cylinder block in accordance with various embodiments of the present invention. Referring to FIG. 1, the engine includes a cylinder block 100, and the cylinder block 100 includes a cylinder liner 120, a liner covering unit 130, and an outer block 140.

The cylinder liner 120, having a cylindrical structure, has an inside circumference on which a piston slides and which forms a cylindrical cylinder space. There are a plurality of cylinder liners 120, such as four cylinder liners 120, arranged on a line with adjacent cylinder liners in close contact with one another. And, the liner covering unit 130 is formed as one unit to surround outer sides of the cylinder liners 120 and close contact parts of the cylinder liners 120.

The outer block 140 is formed on an outside of the liner covering unit 130, to form a cooling water chamber 110 between the outer block 140 and the liner covering unit 130.

The cooling water flowing through the cooling water chamber 110 may exchange heat with the cylinder liners 120 through the liner covering unit 130, and may dissipate heat to an outside of the engine through the outer block 140 and a radiator.

In various embodiments of the present invention, the cylinder liners 120 are in close contact with one another in surface to surface contact with the adjacent cylinder liners 120, which will be described in detail, with reference to FIGS. 2 to 5.

Figure 2:
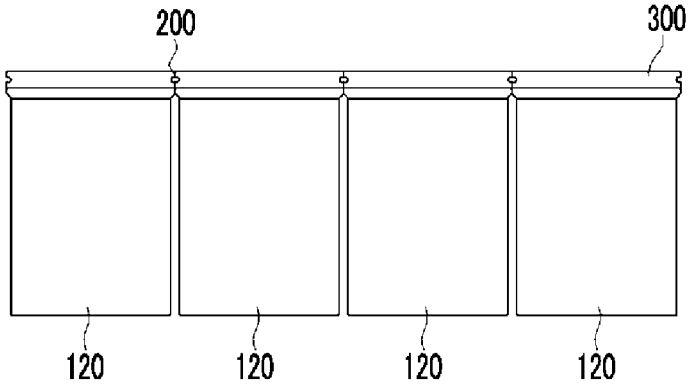
FIG. 2 illustrates a side view of an arrangement of cylinder liners to be built-in in an exemplary cylinder block in accordance with the present invention.
Figure 3:
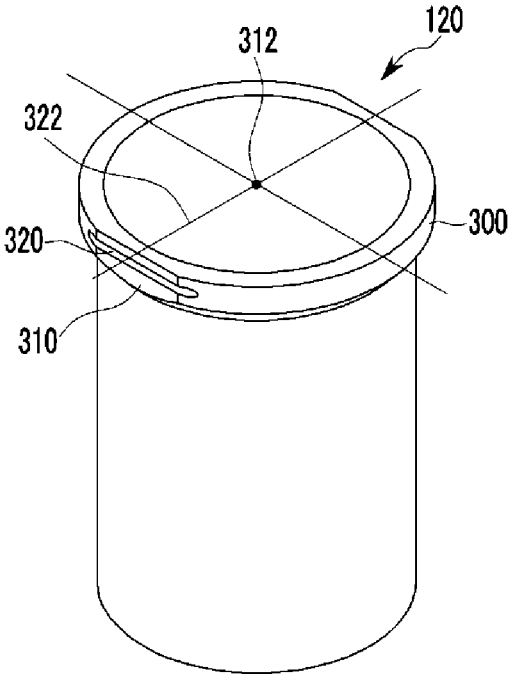
FIG. 3 illustrates a perspective view of a cylinder liner to be built-in in an exemplary cylinder block in accordance with the present invention.

FIG. 2 illustrates a side view of cylinder liners to be built-in in a cylinder block in accordance with various embodiments of the present invention, and FIG. 3 illustrates a perspective view of a cylinder liner to be built-in in a cylinder block in accordance with various embodiments of the present invention.

Referring to FIG. 2, the cylinder liner 120 has a protruded portion 300 from an outside circumference of an upper side thereof formed in a circumferential direction. The protruded portions 300 of adjacent cylinder liners 120 are in close contact to each other at the close contact surface.

Referring to FIG. 3, the cylinder liner 120 has the protruded portion 300 from an outside circumference of an upper side thereof formed in a circumferential direction, with flat surfaces 310 formed on opposite sides thereof.

In various embodiments of the present invention, the flat surfaces 310 are formed perpendicular or substantially perpendicular to an arrangement line 322 on which the cylinder liners 120 are arranged and which passes center points 312 of the cylinder liners 120. And, the flat surface 310 has a groove 320 formed therein. The groove 320 is extended perpendicular or substantially perpendicular to the arrangement line 322.

Figure 4:
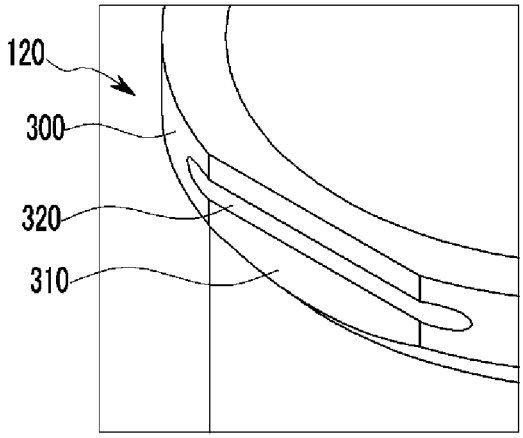
FIG. 4 illustrates a detailed perspective view of a portion of the cylinder block in FIG. 3.
Figure 5:
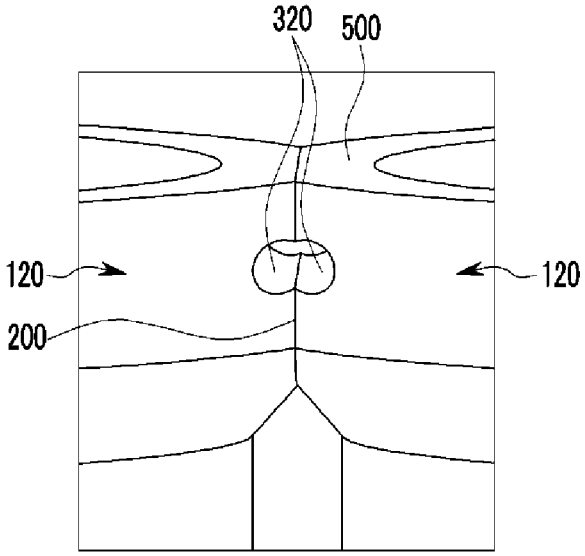
FIG. 5 illustrates a perspective view of adjacent cylinder liners to be built-in in an exemplary cylinder block in accordance with the present invention, showing a fastened state of the adjacent cylinder liners.

FIG. 4 illustrates a detailed perspective view of a portion of the cylinder block in FIG. 3, and FIG. 5 illustrates a perspective view of adjacent cylinder liners to be built-in in a cylinder block in accordance with various embodiments of the present invention, showing a fastened state of the adjacent cylinder liners.

Referring to FIGS. 4 and 5, the cylinder liners 120 are fastened such that the flat surfaces 310 of the protruded portions 300 are in close contact with one another to form the close contact surface 200. And, the grooves 320 are formed to be symmetric or substantially symmetric with each other with respect to the close contact surface 200.

In various embodiments of the present invention, the groove 320 has a cross section larger than a semicircle, but smaller than a circle. Therefore, at the time the liner covering unit 130 is casted, molten metal required for forming the liner covering unit 130 also fills the grooves 320, thereby reinforcing a fastening structure of the cylinder liners 120.

Figure 6:
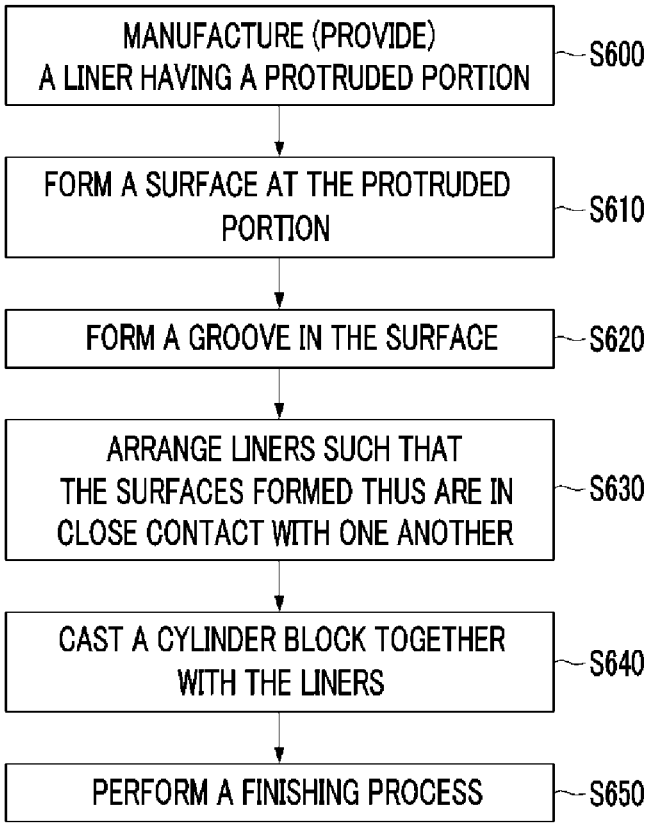
FIG. 6 illustrates a flow chart showing an exemplary method for fabricating an engine having a cylinder block in accordance with the present invention.

FIG. 6 illustrates a flow chart showing the steps of a method for fabricating an engine having a cylinder block in accordance with various embodiments of the present invention. Referring to FIG. 6, in step S600, a cylinder liner 120 having a protruded portion 300 formed thereon is manufactured or provided. In step S610, flat surfaces 310 are formed at the protruded portion 300. Then, in step S620, a groove 320 is formed in the flat surface 310 with grinding or the like.

In various embodiments of the present invention, the flat surface 310 may be formed at the protruded portion 300, together with manufacturing of the cylinder liner 120, or separate from the manufacturing of the cylinder liner 120 by grinding after the cylinder liner 120 is manufactured. And, the groove 320 in the flat surface 310 may be formed together with the flat surface 310 at the time the cylinder liner 120 is being manufactured.

Then, in step S630, the cylinder liners 120 are arranged such that the flat surfaces 310 are in close contact with one another. In this case, opposite grooves 320 are arranged symmetrically with respect to the flat surface 310.

Then, in step S640, a liner covering unit 130, and an outer block 140 are formed together with the cylinder liners 120 arranged thus as one unit by casting, to form a cooling water chamber 110, altogether. Finally, in step S650, the cylinder block 100 is completed by a finishing process.

Eventually, since the cylinder liners 120 are in close contact with one another at the flat surfaces 310 formed at the protruded portion 300, a position of each of the cylinder liners 120 can be maintained precisely, an assemble error can be reduced, and the top side sealing area 500 (See FIG. 5) can be increased according to a protruded size of the protruded portion 300.

Along with this, the molten aluminum alloy, filled in the opposite grooves 320 in the flat surfaces 310 of the protruded portions 300 at the time of casting, is hardened. Accordingly, hardened portions of the aluminum alloy in the grooves 320 fixedly secure the cylinder liners 120, rigidly.

In various embodiments of the present invention, since casting methods of the liner covering unit 130 and the outer block 140, casting material and a temperature, and so on are known, detailed description will be omitted from this specification.

For convenience in explanation and accurate definition in the appended claims, the terms "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine having a cylinder block, comprising:

cylinder liners each having a cylinder space formed therein, a protruded portion formed on an outside circumference thereof, and a flat surface formed on one side of the protruded portion, wherein the cylinder liners are arranged such that flat surfaces of adjacent cylinder liners are in close contact with one another;

a liner covering unit formed to surround an outside of the cylinder liners; and an outer block forming a cooling water chamber with an outside surface of the liner covering unit, wherein the flat surface formed at the protruded portion of one or each of the cylinder liners has a groove formed therein, and wherein molten metal for forming the liner covering unit is filled in the groove.

2. The engine of claim 1, wherein the protruded portion is formed at an upper side of each of the cylinder liners along a circumference, and the flat surface is formed at a portion where the adjacent cylinder liners are in close contact with one another.

3. The engine of claim 1, wherein grooves of the adjacent cylinder liners are substantially symmetrical with respect to a close contact surface defined by the flat surfaces of the adjacent cylinder liners in close contact with one another.

4. The engine of claim 1, wherein the groove is formed in a diameter direction of the corresponding cylinder liner substantially perpendicular to a first direction in which the cylinder liners are arranged, and has a cross section larger than a semi-circle but smaller than a circle.

5. The engine of claim 1, wherein the liner covering unit is formed of a material that is substantially the same as a material of the outer block.

6. The engine of claim 1 wherein the liner covering unit and the outer block are formed as one unit by casting.

7. A method for manufacturing an engine having a cylinder block, the method comprising the steps of:

manufacturing a plurality of cylinder liners, each having a protruded portion formed on an outside thereof;

forming a flat surface at the protruded portion;

forming a groove in the flat surface;

arranging adjacent cylinder liners such that flat surfaces of the adjacent cylinder liners are in close contact and grooves of the adjacent cylinder face one another; and casting molten metal to form a liner covering unit which surrounds an outside of the cylinder liners and an outer block which forms a cooling water chamber around the liner covering unit, wherein molten metal for forming the liner covering unit is filled in and secured to the groove of the flat surface.

8. The method of claim 7, wherein the protruded portion is formed along a circumference at an end portion of the corresponding cylinder liner.

9. The method of claim 7, wherein the groove is formed in a diameter direction of the corresponding cylinder liner substantially perpendicular to a first direction in which the cylinder liners are arranged, and has a cross section larger than a semi-circle but smaller than a circle.

* * * * *